US007959506B2

(12) United States Patent
Toyoda

(10) Patent No.: US 7,959,506 B2
(45) Date of Patent: Jun. 14, 2011

(54) GAMING MACHINE

(75) Inventor: Hirobumi Toyoda, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 937 days.

(21) Appl. No.: 11/902,122

(22) Filed: Sep. 19, 2007

(65) Prior Publication Data

US 2008/0076564 A1 Mar. 27, 2008

(30) Foreign Application Priority Data

Sep. 22, 2006 (JP) ..... 2006-258098

(51) Int. Cl.
*A63F 9/24* (2006.01)
*A63F 9/00* (2006.01)

(52) U.S. Cl. ..... 463/20; 463/19; 463/30; 463/31; 463/46; 273/457

(58) Field of Classification Search ..... 463/20, 463/29, 31, 46, 30; 273/457; 119/245
See application file for complete search history.

(56) References Cited

U.S. PATENT DOCUMENTS 5,857,910 A * 1/1999 Watanabe et al. ..... 463/17
2004/0018865 A1 * 1/2004 Gilmore et al. ..... 463/7

FOREIGN PATENT DOCUMENTS

JP 2001-046583 A 2/2001
JP 2005-230190 A 9/2005
JP 2006-141634 A 6/2006

* cited by examiner

*Primary Examiner* — David L Lewis
*Assistant Examiner* — Omkar Deodhar
(74) *Attorney, Agent, or Firm* — Arent Fox LLP

(57) ABSTRACT

A gaming machine includes: a CPU 106 which determines whether or not the game state is to be switched to a special game state advantageous to a player; mechanical reels 30A through 30C formed of a translucent material to display multiple kinds of indicating information variably and statically; a motor driving circuit 120 which controls the mechanical reels 30A through 30C; a water tank 500 formed of a translucent material to retain liquid, and provided behind a display screen 10; lamps 650*a* through 650*w* for emitting multiple kinds of lights toward the liquid stored in the water tank 500; and a drive control circuit 300 which performs a control operation that instructs the lamps 650*a* through 650*w* to emit a light selected from among the multiple kinds of lights according to the result of the determination made by the CPU 106.

2 Claims, 10 Drawing Sheets

FIG. 5

LIGHT-EMISSION/ILLUMINATION INTENSITY TABLE

| PROBABILITY THAT GAME STATE WILL TRANSIT TO ADVANTAGEOUS GAME STATE (%) | KIND OF LIVING THING | ILLUMINATION INTENSITY OF LAMP (RATIO) |
|---|---|---|
| 100 | LIVING THING600e | 100 |
| 80 | LIVING THING600d | 80 |
| 60 | LIVING THING600c | 60 |
| 40 | LIVING THING600b | 40 |
| 20 | LIVING THING600a | 20 |

GAMING MACHINE

This application is based on and claims the benefit of priority from Japanese Patent Application No. 2006-258098, filed on 22 Sep. 2006, the content of which is incorporated herein by reference.

BACKGROUND OF THE INVENTION

1. Field of the Invention

The present invention relates to a gaming machine such as a slot machine, a pachinko-style slot machine, and a pachinko machine.

2. Related Art

With conventional gaming machines (slot machines), upon the player manipulating an operating means (start lever) after the insertion of a predetermined number of units of a gaming medium (coins or the like), a display means (reels or a liquid crystal display device), which displays multiple indicating information on the outer face thereof in the form of multiple lines (e.g., in the form of a 3×3 matrix), enters a scrolling display mode.

Furthermore, such gaming machines provide the following game. That is to say, upon the player operating the start lever, reels or the like are rotated a predetermined number of times (for a predetermined period of time), following which the rotation thereof is stopped. Then, such a gaming machine pays out an amount of coins based upon the combination of the indicating information rearranged along an active pay line provided to the display means that allows the player to recognize the indicating information.

In addition, in recent years, various ideas have been proposed for improving visual effects. For example, an idea has been proposed for the aforementioned gaming machines, in which a hollow container filled with a liquid is provided forward of a lower panel of a cabinet of the slot machine. With such an arrangement, movable members such as simulated aquatic plants, simulated fishes, etc., are provided within the hollow container. Furthermore, a bubble generator is provided to the hollow container, which provides bubbles into the liquid thus stored (see Patent Document 1).

With the gaming machine disclosed in Patent Document 1, the bubble generator provides bubbles in the liquid according to the progress and situations of the game, thereby providing improved visual effects.

However, with the gaming machine disclosed in Patent Document 1, such components are mounted at a different location from that of the display means that allows the player to recognize the changeable indicating information, leading to a problem that such components do not attract much attention from the player. In order to solve this problem, a gaming machine is proposed in which a water tank is provided forward of the display means that allows the player to recognize the indicating information of variable display displayed thereon. Such an arrangement provides improved visual effects, examples of which include bubbles provided within the water tank, visual effects provided by a transparent liquid crystal display device provided between the water tank and the display means, etc. (see Patent Documents 2 and 3).

With the gaming machines disclosed in Patent Documents 2 and 3, the water tank is provided forward of the display means that allows the player to recognize the indicating information of variable display displayed thereon. Such an arrangement allows the player to recognize the indicating information of variable display displayed on the display means while viewing the visual effects provided by the water tank. Thus, such visual effects attract the player's attention.

[Patent Document 1]

Japanese Unexamined Patent Application, First Publication No. 2001-46583

[Patent Document 2]

Japanese Unexamined Patent Application, First Publication No. 2005-230190

[Patent Document 3]

Japanese Unexamined Patent Application, First Publication No. 2006-141634

However, there is a problem with the gaming machines disclosed in Patent Documents 2 and 3, which have a structure in which the water tank is provided forward of the display means. That is to say, with such an arrangement, the information provided by the display means is thus displayed to the player through the medium of the water tank. In some cases, if something interrupts the player's view, or if there is a large distance between the display means and the player, the player cannot recognize the information displayed by the display means. Such a problem limits the permissible size and shape of the water tank, leading to such a water tank providing only limited visual effects.

The present invention has been made in view of the aforementioned problem. It is an object of the present invention to provide a gaming machine which provides improved visual effects using a water tank, while facilitating the player's ability to visually recognize the information displayed by the display means.

SUMMARY OF THE INVENTION

In order to achieve the aforementioned purpose, the present invention provides the following arrangements.

In a first aspect of the present invention, a gaming machine includes: an operating means for allowing a player to operate the gaming machine; a game control means for providing a function whereby, upon the player performing an operation on the operating means, determination is made whether or not a game state is to be switched to a special game state advantageous to the player; a display means, which is formed of a translucent material, for displaying multiple kinds of indicating information variably and statically; a display control means for controlling a display operation of the display means, which provides a function of displaying the indicating information variably and statically, according to the result of a determination made by the game control means; a water tank which is formed of a translucent material, retains liquid, and is provided behind a display screen of the display means for displaying the indicating information; a light emitting means for emitting multiple kinds of lights toward the liquid stored in the water tank; and a light emission control means for controlling an operation which instructs the light emitting means to emit a light selected from among the multiple kinds of lights according to the result of the determination made by the game control means.

According to the first aspect of the invention, when the player operates the operating means, the game control means determines whether or not the game state is to be switched to the special game state advantageous to the player. The display means, which is formed of a translucent material, displays multiple kinds of indicating information variably and statically. The display control means controls the display operation of the display means, which has a function of displaying the indicating information variably and statically, according to the result of the determination made by the game control means. A water tank, which retains liquid and is formed of a translucent material, is provided behind the display screen that displays the indicating information provided by the display means.

With such an arrangement, the light emission control means performs a control operation which instructs the light emitting means, which has a function of emitting multiple kinds of lights, to emit a light selected from among the multiple kinds of lights toward the liquid stored in the water tank according to the result of the determination made by the game control means.

With such an arrangement, the water tank, which retains liquid, is provided behind the display means, which provides a function of displaying the multiple kinds of indicating information variably and statically. Such an arrangement allows the player to simultaneously recognize both the multiple kinds of indicating information displayed by the display means via the display screen and the water tank provided behind the display screen. In addition, the water tank can be designed without having to take into account whether or not the water tank interrupts the player's view of the display screen that displays the indicating information provided by the display means (e.g., reels or liquid crystal display device). Thus, with such an arrangement, the water tank can be formed with an increased depth as compared with an arrangement in which the water tank is provided forward of the display means. Various kinds of items which provide visual effects (e.g., simulated pirate ships, simulated tropical fish, and simulated aquatic plants, all of which can be moved by magnetic force) can be arranged in such a water tank thus designed.

Furthermore, the display means provides a function of displaying the indicating information variably and statically according to the result of the determination made by the game control means of whether or not the game state is to be switched to the special game state advantageous to the player. In addition, the light emitting means provides a function of emitting a light selected from among the multiple kinds of lights toward the liquid stored in the water tank according to the result of the determination. Thus, with such an arrangement, visual effects, including the display of indicating information variably and statically and the emission of light in which a particular kind of light is emitted toward the liquid stored in the water tank, are displayed in a superimposed manner. The player is thus notified that the game state will transit to a special game state advantageous to the player, which is of great interest to the player. This provides improved visual effects by using the water tank.

Thus, such an arrangement provides improved visual effects by using the water tank, while facilitating the player's ability to visually recognize the information displayed by the display means.

In a second aspect of the gaming machine as described in the first aspect of the present invention, the water tank may be stocked with a visible living thing. The gaming machine may further include a position identifying means which identifies the position of the living thing. The light emission control means may perform a control operation which instructs the light emitting means to emit light toward the living thing based upon the position of the living thing identified by the position identifying means.

According to the second aspect of the invention, the light emission control means controls the light emitting means such that it emits light toward the living thing stored in the water tank based upon the position of the living thing identified by the position identifying means.

Such an arrangement provides a function of emitting a light selected from among multiple kinds of lights toward the living thing.

For example, with such an arrangement, the game control means determines by random number lottery whether or not the game state is to be switched to a special game state advantageous to the player, upon which the light emission control means performs a control operation which instructs the light emitting means to emit a light selected from among the multiple kinds of lights with reference to an illumination intensity table according to the result of the determination of whether or not the game state is to be switched to the special game state advantageous to the player. A storage means is provided which stores an illumination intensity table that specifies the relation between the probability that the game state will transit to the advantageous game state, which is used in the random number lottery processing, and the illumination intensity of the light to be emitted by the light emitting means. In the illumination intensity table, the illumination intensity of the light is proportional to the probability that the game state will transit to the advantageous game state. With such an arrangement, the illumination intensity of the light to be emitted becomes higher as the probability that the game state will transit to the advantageous game state becomes greater. With such an arrangement, the emission of light at a high illumination intensity further enhances the player's sense of expectation with respect to the game state transition to the special game state advantageous to the player.

Thus, such an arrangement provides improved visual effects by using the water tank, while facilitating the player's ability to visually recognize the information displayed by the display means.

In a third aspect of the gaming machine as described in the first aspect of the present invention, the water tank may be stocked with multiple kinds of visible living things. The gaming machine may further include: a kind identifying means for identifying the kind of each of the multiple kinds of living things; and a storage means for storing a light emission table that specifies the association between the kind of each of the multiple kinds of living things and a corresponding light from among multiple kinds of lights, which are used in a light emission operation of the light emitting means which has a function of emitting multiple kinds of lights.

With such an arrangement, the light emission control means may perform a control operation which instructs the light emitting means to emit a light selected from among the multiple kinds of lights according to the kind of living thing identified by the kind identifying means with reference to the light emission table stored in the storage means.

According to the third aspect of the invention, the kind identifying means identifies the kind of each of multiple kinds of living things. The storage means stores an illumination table that specifies the association between each of the multiple kinds of living things and the corresponding light emission data from among the multiple kinds of light emission data, which is used in the light emission operation of the light emitting means for emitting each of the multiple kinds of lights.

With such an arrangement, the light emission control means performs a control operation which instructs the light emitting means to emit a light selected from among the multiple kinds of lights according to the kind of living thing identified by the kind identifying means with reference to the light emission table stored in the storage means.

Such an arrangement provides a function of emitting, toward a particular living thing, a light selected from among the multiple kinds of lights according to the living thing thus identified.

For example, with such an arrangement, the game control means determines by random number lottery whether or not the game state is to be switched to a special game state advantageous to the player, upon which the light emission control means performs a control operation which instructs the light emitting means to emit a light selected from among the multiple kinds of lights with reference to the light emission table according to the result of the determination of whether or not the game state is to be switched to the special game state advantageous to the player. A storage means is provided for storing a light emission table that specifies the relation between the probability that the game state will transit to the advantageous game state, which is used in the random number lottery processing, and the multiple kinds of living things. With such an arrangement, the living thing thus selected as a targeted living thing to be illuminated is changed according to an increase in the probability that the game state will transit to the advantageous game state. With such an arrangement, illumination of a particular living thing further enhances the player's sense of expectation with respect to the game state transition to the special game state advantageous to the player.

Thus, such an arrangement provides improved visual effects by using the water tank, while facilitating the player's ability to visually recognize the information displayed by the display means.

According to the present invention, a water tank that retains liquid is provided behind a display screen for displaying indicating information provided by a display means, which has a function of displaying multiple kinds of indicating information variably and is formed of a translucent material. With such an arrangement, a light emission control means performs a control operation which instructs the light emitting means, which has a function of emitting multiple kinds of lights, to emit a light selected from among multiple kinds of lights toward the liquid stored in the water tank according to the result of the determination made by the game control means. Thus, such an arrangement provides further improved visual effects by using the water tank, while facilitating the player's ability to visually recognize the information displayed by the display means.

BRIEF DESCRIPTION OF THE DRAWINGS

FIG. 5 is a diagram showing a light-emission/illumination intensity table according to the embodiment of the present invention.

DETAILED DESCRIPTION OF THE INVENTION

A detailed description is provided below regarding embodiments of the present invention.

First Embodiment

Figure 1:
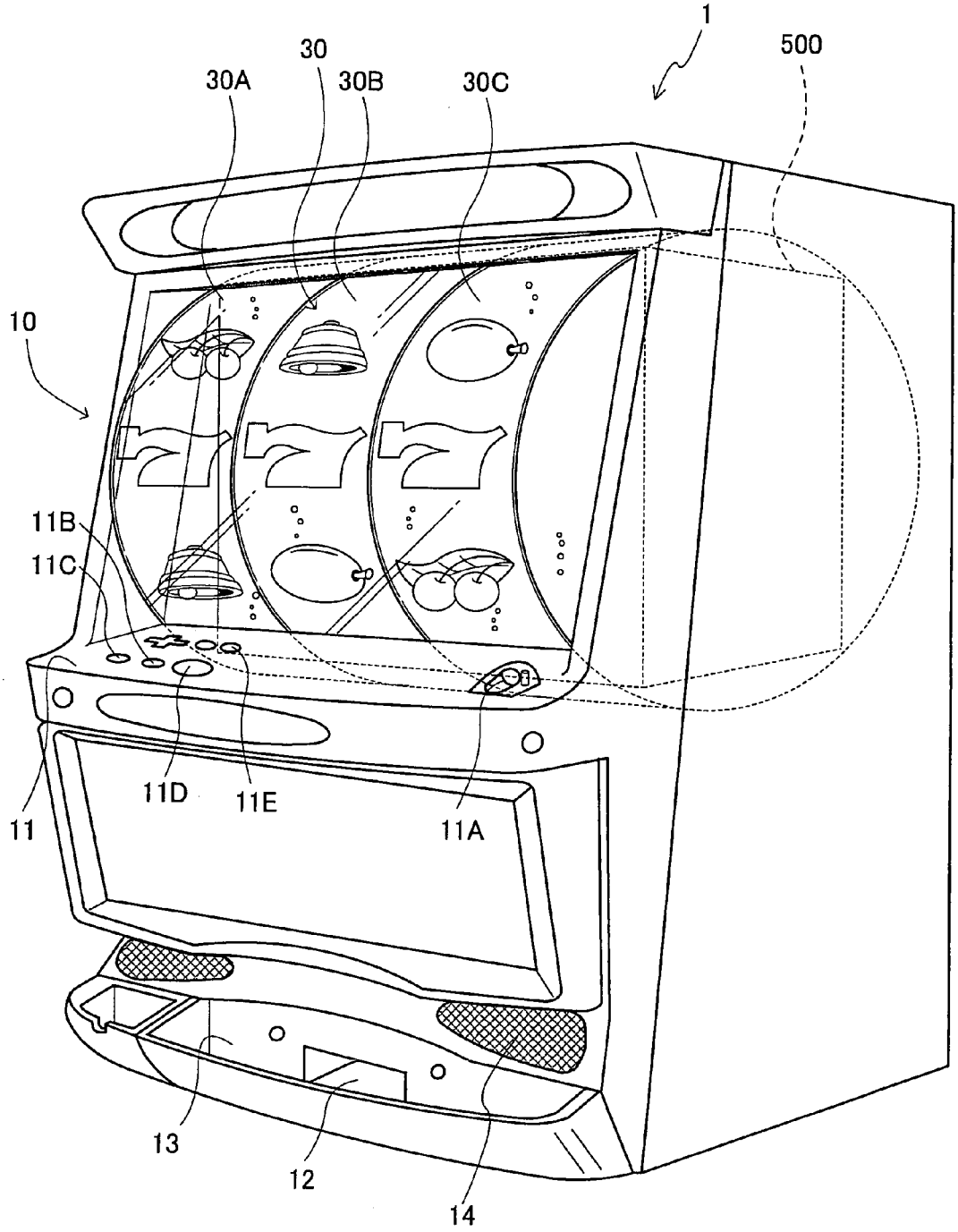
FIG. 1 is a perspective view showing the exterior of a slot machine according to a first embodiment of the present invention.

FIG. 1 is a perspective view showing the exterior of a slot machine 1 according to a first embodiment of the present invention. The slot machine 1 according to the embodiment of the present invention includes a reel group 30, an operation panel 11, a coin payout opening 12, a coin tray 13, and a sound output unit 14. It should be noted that slot machines can be roughly classified into two types. One is a slot machine having a configuration in which mechanical reels are rotated. The other is a so-called video slot machine having a configuration in which multiple virtual reels are rotated in the form of an image displayed on a screen. While a description is provided in the present embodiment regarding a slot machine employing mechanical reels, the present invention may also be applied to a video slot machine.

The slot machine 1 is installed at a predetermined location in an amusement facility such as a casino, etc. Furthermore, the slot machine 1 includes a control device 100 (see FIG. 3) or the like mounted therewithin for electrically controlling each component thereof. A description is provided later regarding the control device 100.

The reel group 30 has a structure in which three cylindrical mechanical reels 30A through 30C are rotatably provided along a horizontal line. Furthermore, the mechanical reels 30A through 30C are provided such that they can rotate around the circumference of a water tank 500. Multiple kinds of indicating information are provided on the outer face of each of the mechanical reels 30A through 30C. Such an arrangement displays the indicating information variably and statically on a display screen 10 that allows the player to recognize the indicating information. The multiple kinds of indicating information include a "red 7" design, a "blue 7" design, a "BAR" design, a "bell" design, a "watermelon" design, and a "cherry" design. Here, each of the three mechanical reels 30A through 30C is formed of a translucent material.

In other words, the mechanical reels 30A through 30C provide a function of displaying the multiple kinds of indicating information variably and statically. That is to say, the mechanical reels 30A through 30C serve as an example of a display means formed of a translucent material. Furthermore, each of the mechanical reels 30A through 30C is formed in a cylindrical shape, on the outer face of which are depicted multiple indicating information. Each reel is provided such that it can be rotated around the circumference of the water tank.

The operation panel 11 includes a coin insertion opening 11A which allows the player to insert coins into the slot machine 1. Furthermore, the operation panel 11 includes a BET switch 11B which allows the player to select the number of coins, which serve as the units of the gaming medium used in the game by the player. Moreover, the operation panel 11 includes a spin repeat bet switch 11C which allows the player to play the game again without changing the number of coins to be spent in the game from that in the immediately previous game. The slot machine 1 allows the player to set the number of coins to be spent in the game by performing a pushing operation on either the BET switch 11B or the spin repeat bet switch 11C.

Furthermore, the operation panel 11 includes a start switch 11D which is a game start instruction receiving means that allows the player to input the game start instruction in increments of games. With the slot machine 1, upon the player performing a pushing operation on either the spin repeat bet switch 11C or the start switch 11D, a start operation signal is transmitted to a CPU 106 (see FIG. 3) described later. This starts the game, upon which a scrolling operation is performed for the reel group 30.

Furthermore, the operation panel 11 includes a payout switch 11E. Upon the player performing a pushing operation on the payout switch 11E, the coins inserted by the player are paid out via the coin payout opening 12. The coins to be paid out are retained in the coin tray 13.

Figure 2:
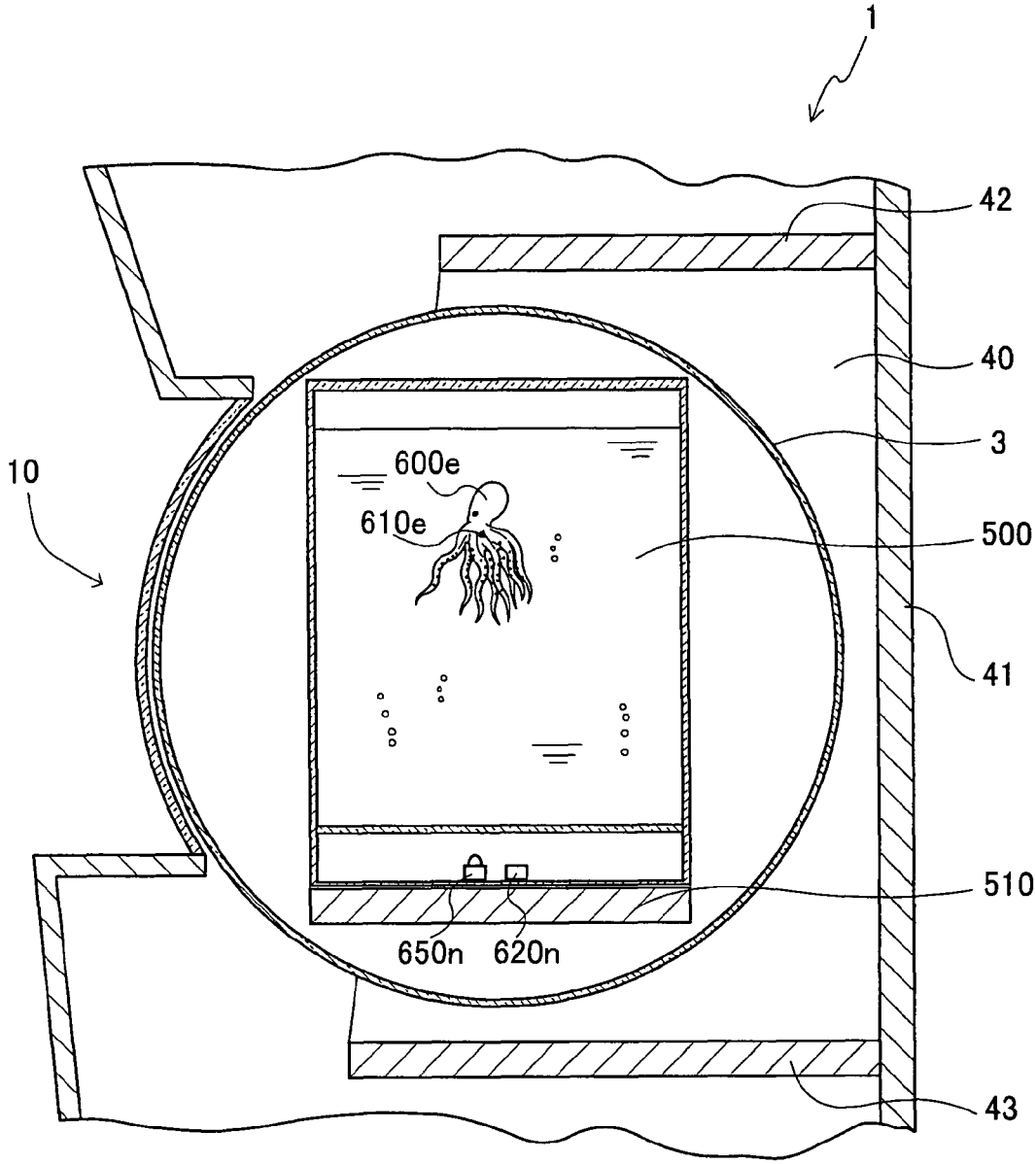
FIG. 2 is a cross-sectional view showing a reel group and a water tank included in the slot machine according to the first embodiment of the present invention.

FIG. 2 is a cross-sectional diagram showing the reel group 30 and the water tank 500 included in the slot machine 1 according to the first embodiment of the present invention.

Each of the mechanical reels 30A through 30C is independently rotatably supported by a reel frame 40. It should be noted that an unshown stepping motor is provided to the reel frame 40 for providing a function of rotating each of the mechanical reels 30A through 30C, and a function of stopping the rotation thereof. The reel frame 40 is provided between an upper frame 42 and a lower frame 43 provided to a main frame 41.

The water tank 500 is provided in the space within the three cylindrical mechanical reels 30A through 30C, and is supported by the cabinet of the slot machine 1 through a water tank frame 510. Here, the water tank 500 is formed approximately in the shape of a rectangular parallelepiped, and is formed of a translucent material which is capable of retaining liquid. It should be noted that the water tank 500 according to the present embodiment is not restricted to such an arrangement. Rather, the water tank 500 may be formed in a desired shape, e.g., substantially in the shape of a cylinder. Also, various kinds of items for providing visual effects may be arranged within the water tank 500 (examples of which include simulated pirate ships, simulated tropical fish, and simulated aquatic plants, all of which can be moved by magnetic force).

In other words, the water tank 500 is provided behind the display screen that serves as a display means for displaying the indicating information. Here, the water tank 500 is a water tank which is capable of retaining liquid and is formed of a translucent material, for example.

The water tank 500 is stocked with visible living things 600*a* through 600*e* (FIG. 2 shows the living thing 600*e* as an example). With such an arrangement, resonant tags 610*a* through 610*e* are provided to the respective living things 600*a* through 600*e* (FIG. 2 shows the resonant tag 610*e* as an example). Furthermore, lamps 650*a* through 650*w* (FIG. 2 shows the lamp 650*n* as an example) are arranged near the bottom of the water tank 500 at substantially equal intervals, each of which emits light toward the liquid stored in the water tank 500. In addition, sensors 620*a* through 620*w* (FIG. 2 shows the sensor 620*n* as an example) are provided near the bottom of the water tank 500, each of which has a function of emitting electromagnetic waves toward the resonant tags 610*a* through 610*e*, and a function of receiving echo waves reflected from the resonant tags 610*a* through 610*e*.

In other words, the lamps 650*a* through 650*w* serve as an example of a light emitting means for emitting multiple kinds of lights toward the liquid stored in the water tank.

Next, a description is provided regarding a configuration of the control device 100.

Figure 3:
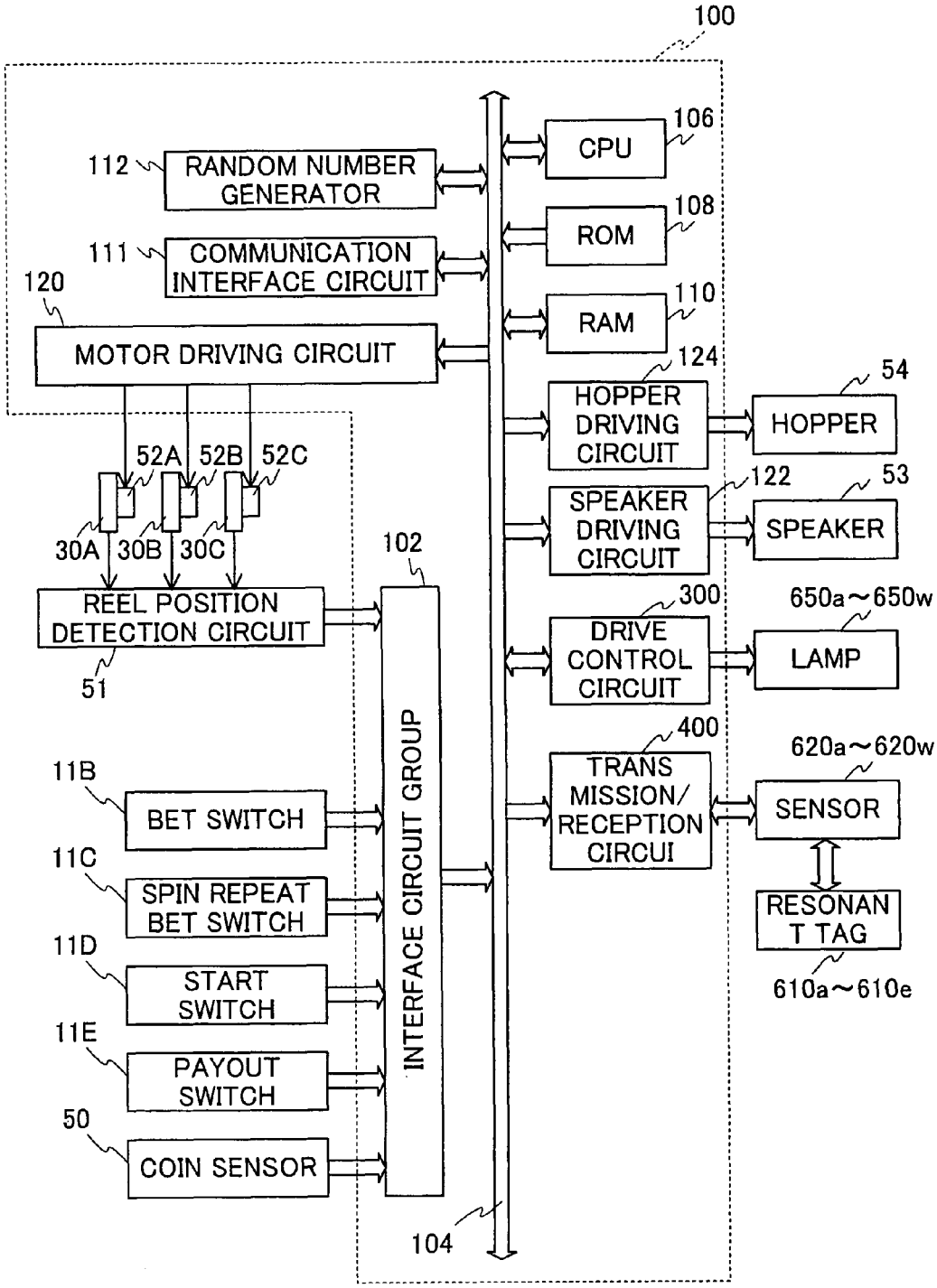
FIG. 3 is a block diagram showing an electrical configuration of a control device according to the first embodiment of the present invention.

FIG. 3 is a block diagram showing an electrical configuration of the control device 100 according to a first embodiment of the present invention.

The control device 100 is a microcomputer, and includes an interface circuit group 102, an input/output bus 104, a CPU 106, ROM 108, RAM 110, a communication interface circuit 111, a random number generator 112, a motor driving circuit 120, a speaker driving circuit 122, and a hopper driving circuit 124.

The interface circuit group 102 is connected to the input/output bus 104. Furthermore, the input/output bus 104 inputs and outputs data signals or address signals to and from the CPU 106.

The start switch 11D is connected to the interface circuit group 102. The start signal output from the start switch 11D is converted into a predetermined signal by the interface circuit group 102, and the start signal thus converted is supplied to the input/output bus 104.

Furthermore, the BET switch 11B, the spin repeat BET switch 11C, and the payout switch 11E are connected to the interface circuit group 102. Each of the switching signals output from these switches 11B, 11C, and 11E is also supplied to the interface circuit group 102, and is converted into a predetermined signal by the interface circuit group 102. The switching signals thus converted are supplied to the input/output bus 104.

Moreover, a coin sensor 50 is connected to the interface circuit group 102. The coin sensor 50 is a sensor for detecting the coins inserted into the coin insertion opening 11A. The coin sensor 50 is provided in combination with the coin insertion opening 11A. The sensing signal output from the coin sensor 50 is also sent to the interface circuit group 102, and is converted into a predetermined signal by the interface circuit group 102. The sensing signal thus converted is sent to the input/output bus 104.

In addition, a reel position detecting circuit 51 is connected to the interface circuit group 102. The reel position detecting circuit 51 is a circuit for detecting the rotational position for each of the mechanical reels 30A through 30C based upon the pulse signals received from a reel rotational position sensor (not shown). The detection signal output from the reel position detecting circuit 51 is also sent to the interface circuit group 102, and is converted into a predetermined signal by the interface circuit group 102. The detection signal thus converted is supplied to the input/output bus 104.

Furthermore, the ROM 108 and the RAM 110 are connected to the input/output bus 104.

According to a program stored in the ROM 108, which is described later in detail, the CPU 106 controls the execution of a game provided by the slot machine 1.

The ROM 108 stores: a control program for central control of the slot machine 1; initialization data for executing the control program; and various data tables used in the lottery processing.

The RAM 110 temporarily stores flags, variables, and position data for each of the living things 600*a* through 600*e*, etc., used for the aforementioned control program.

Furthermore, a communication interface circuit 111 is connected to the input/output bus 104. The communication interface circuit 111 is a circuit for communicating with a server, etc., via various kinds of communication networks including a public telephone line network, LAN, etc.

Moreover, the random number generator 112 for generating a random number is connected to the input/output bus 104. The random number generator 112 generates a random number in a predetermined range, e.g., a range between 0 and 65535. Alternatively, an arrangement may be made in which the CPU 106 generates a random number by computation.

A motor driving circuit 120 for driving the stepping motors 52A through 52C is connected to the input/output bus 104. The CPU 106 controls the operations of the stepping motors 52A through 52C via the motor driving circuit 120 according to the occurrence of predetermined events.

In addition, the speaker driving circuit 122 for driving the speaker 53 is connected to the input/output bus 104. The CPU 106 reads out the sound data stored in the ROM 108, and transmits the sound data thus read out to the speaker driving circuit 122 via the input/output bus 104, thereby providing predetermined sound effects generated by the speaker 53.

Furthermore, the hopper driving circuit 124 for driving the hopper 54 is connected to the input/output bus 104. Upon reception of a cash out signal input from the payout switch 11E, the CPU 106 transmits a driving signal to the hopper driving circuit 124 via the input/output bus 104. The hopper 54 then proceeds to pay out an amount of coins that corresponds to the credit remaining at the current point in time, as stored in a predetermined memory area of the RAM 110.

Moreover, a drive control circuit 300 is connected to the input/output bus 104, which provides a function of driving the lamps 650*a* through 650*w*. If a predetermined event occurs, the CPU 106 controls the operations of the lamps 650*a* through 650*w* via the drive control circuit 300, which instructs the lamps 650*a* through 650*w* to emit a corresponding light from among the multiple kinds of lights. With such an arrangement, each of the lamps 650*a* through 650*w* is associated with position information. Upon reception of the position data transmitted from the CPU 106, the drive control circuit 300 converts the position data thus received to the position information, and performs a control operation so as to instruct the corresponding lamp, which has been associated with the position information thus converted and is selected from among the lamps 650*a* through 650*w*, to emit light.

In addition, a transmission/reception circuit 400 is connected to the input/output bus 104, which provides a function of instructing the sensors 620*a* through 620*w* to emit electromagnetic waves having respectively different frequencies toward the interior of the water tank 500 at prescribed intervals, and a function of instructing the sensors 620*a* through 620*w* to receive the echo waves reflected from each of the resonant tags 610*a* through 610*e* with the respectively different frequencies. If the transmission/reception circuit 400 receives an echo wave via any one of the sensors 620*a* through 620*w*, the transmission/reception circuit 400 identifies the corresponding resonant tag that emitted this echo wave from among the resonant tags 610*a* through 610*e*. Furthermore, the transmission/reception circuit 400 transmits the data that indicates which sensor among the sensors 620*a* through 620*w* has received this echo wave to the CPU 106. Then, the CPU 106 stores the relation between the resonant tag (selected from among the resonant tags 610*a* thorough 610*e*) that has reflected echo waves, and the sensor (selected from among the sensors 620*a* through 620*w*) that has received the echo waves thus reflected, for each of the living things 600*a* through 600*e* as position data in the RAM 110.

Each of the resonant tags 610*a* through 610*e* includes a resonant circuit. With such an arrangement, the resonant tags 610*a* through 610*e* are provided to the respective living things 600*a* through 600*e* with which the water tank has been stocked. Each resonant circuit has a function whereby, upon reception of an electromagnetic wave with a predetermined frequency set beforehand, an echo wave is emitted, using a resonant mechanism, with the same frequency as the electromagnetic wave thus received. The resonant tags 610*a* through 610*e* are set beforehand such that they resonate with the electromagnetic waves at different frequencies. With such an arrangement, based upon the frequency of the echo wave thus received, the transmission/reception circuit 400 identifies the resonant tag that emitted the echo wave from among the resonant tags 610*a* through 610*e*.

Figure 4:
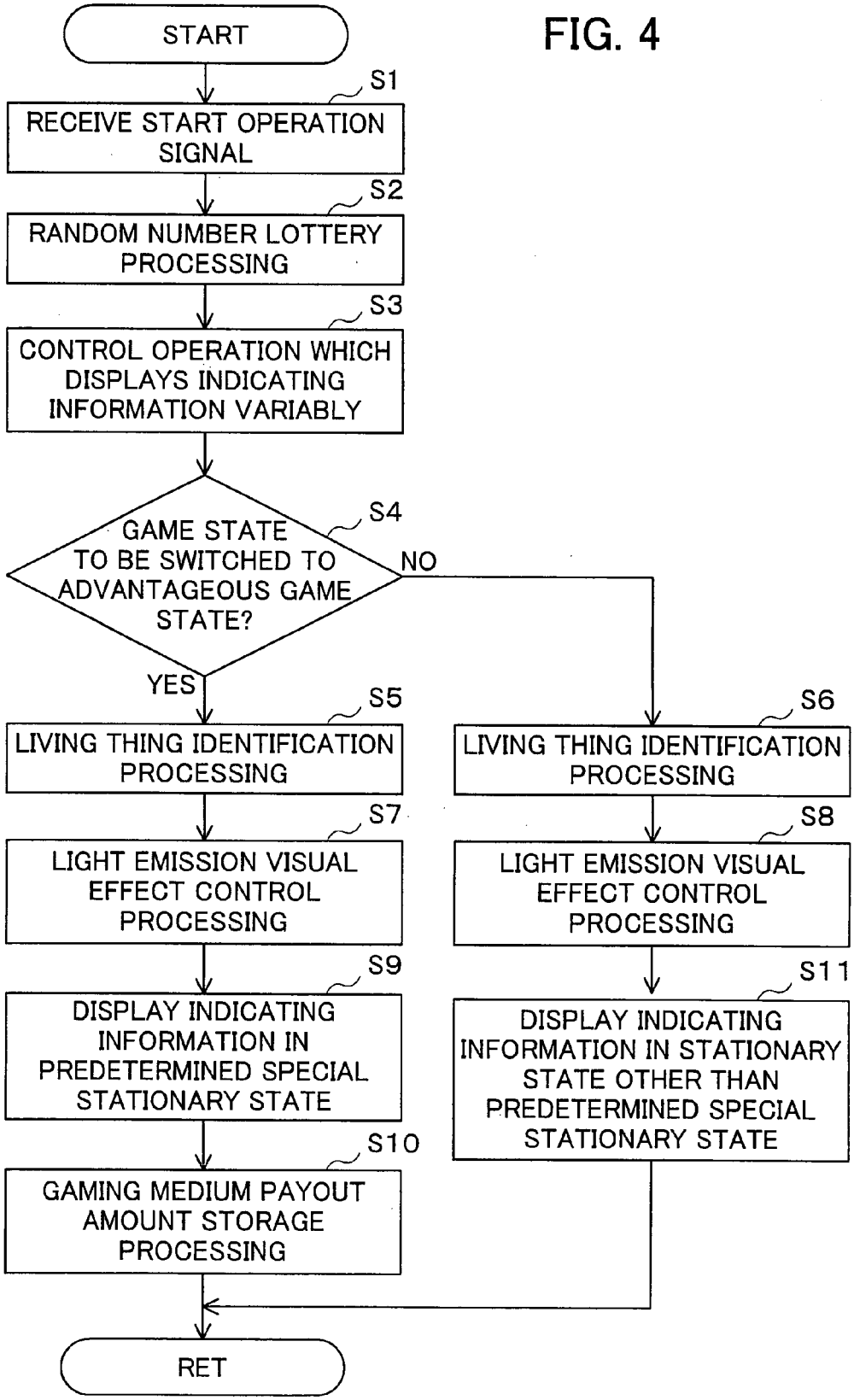
FIG. 4 is a flowchart for a game control means included in the slot machine according to the embodiment of the present invention.

Next, a description is provided regarding the operation of the CPU 106 that controls the execution of a game provided by the slot machine 1 according to the first embodiment with reference to a flowchart shown in FIG. 4.

In step S1, the CPU 106 receives a start operation signal. In this processing, upon the player performing a pushing operation on either the spin repeat bet switch 11C or the start switch 11D, a start operation signal is transmitted, upon which the CPU 106 receives the start operation signal thus transmitted. Upon completion of this processing, the CPU 106 switches the processing to step S2.

In step S2, the CPU 106 performs random number lottery processing. In this processing, the CPU 106 instructs the random number generator 112 to generate a random number, and extracts the random number thus generated. Upon completion of this processing, the CPU 106 switches the processing to step S3.

In step S3, the CPU 106 performs indicating information variable display control processing. In this processing, the CPU 106 transmits a command which instructs the motor driving circuit 120 to rotate the mechanical reels 30A through 30C. Upon reception of this command, the motor driving circuit 120 performs a control operation so as to rotate the mechanical reels 30A through 30C. In other words, the motor driving circuit 120 serves as an example of a display control means which is a rotational driving device for driving the reels. Upon completion of this processing, the CPU 106 switches the processing to step S4.

In step S4, the CPU 106 determines whether or not the game state is to be switched to an advantageous game state. In this processing, the CPU 106 determines whether or not the random number thus extracted in step S2 is within a predetermined range. In a case where the CPU 106 determines that the random number is within the predetermined range, the CPU 106 determines that the game state is to be switched to the advantageous game state, upon which the processing is switched to step S5. On the other hand, in a case where the CPU 106 does not determine that the random number is within the predetermined range, the CPU 106 determines that the game state is not to be switched to the advantageous game state, upon which the processing is switched to step S6.

In other words, the CPU 106 provides: a function as an operating means which allows the player to operate the slot machine 1; and a function as an example of a game control means which determines, for every instance of the player performing an operation via the operating means, whether or not the game state is to be switched to the game state that is advantageous to the player.

The term "game state advantageous to the player" represents a state in which the following conditions are satisfied. First, in the processing in step S5 described later, the condition where the indicating information depicted on the mechanical reels 30A through 30C are displayed on the display screen 10 in a predetermined stationary state (e.g., the indicating information "red 7", "red 7", and "red 7" are rearranged in the stationary state). Second, in the processing in step S6 described later, the condition where the gaming medium payout amount is stored in a predetermined memory region of the RAM 110, which is used in payout processing in which a predetermined amount of the gaming medium is paid out.

In step S5 and step S6, the CPU 106 performs living thing identification processing. In this processing, the CPU 106 reads out the position data stored in the RAM 110 for each of the living things 600*a* through 600*e*, thereby identifying the living things 600*a* through 600*e* and the positions thereof. The CPU 106 transmits the position data to the drive control circuit 300. Upon completion of this processing, the CPU 106 switches the processing to step S7 or step S8.

In other words, the CPU 106 serves as an example of a position identifying means for identifying the position of each living thing. In addition, the CPU 106 serves as an example of a kind identifying means for identifying the kind of each living thing among the multiple kinds of living things.

In step S7 and step S8, the CPU 106 performs light emission visual effect control processing. In this processing, from among the living things 600*a* through 600*e*, the CPU 106 determines the living thing toward which light is to be emitted, with reference to a light-emission/illumination intensity table (see FIG. 5) according to the result of the determination made in step S4. Furthermore, the CPU 106 determines the illumination intensity of the lamp with reference to the light-emission/illumination intensity table (see FIG. 5) according to the result of the determination made in step S4. The CPU 106 transmits the data to the drive control circuit 300 with respect to the kind of living thing targeted and the illumination intensity. Upon completion of this processing, the CPU 106 switches the processing to step S9 or step S11.

The drive control circuit 300 determines which lamp from among the lamps 650*a* through 650*w* is to be turned on, based upon the data with respect to the kind of living thing and the illumination intensity, and the position data for each of the living things 600*a* through 600*e*, transmitted in step S5 and step S6. Then, the drive control circuit 300 controls the lamp thus selected such that it emits light with an illumination intensity that corresponds to the data with respect to the illumination intensity.

In other words, the drive control circuit 300 serves as an example of a light emission control means for controlling the light emitting means such that it emits a light selected from among multiple kinds of lights according to the result of the determination made by the game control means. Furthermore, the drive control circuit 300 serves as an example of a light emission control means for controlling the light emitting means such that it emits light toward a targeted living thing according to the position of the living thing detected by the position identifying means. In addition, the drive control circuit 300 serves as an example of a light emission control means for controlling the light emitting means such that it emits a light selected from among the multiple kinds of lights with reference to the light emission table stored in a storage means corresponding to the kind of living thing detected by the kind identifying means.

In step S9, the CPU 106 performs a control operation so as to display the indicating information in a predetermined special stationary state. In this processing, the CPU 106 transmits a command which is an instruction to the motor driving circuit 120 to display the indicating information depicted on the mechanical reels 30A through 30C on the display screen 10 in a predetermined special stationary state (e.g., the indicating information "red 7", "red 7", and "red 7" are rearranged in the stationary state). Upon reception of this command, the motor driving circuit 120 performs a control operation so as to display the indicating information depicted on the mechanical reels 30A through 30C on the display screen 10 in the predetermined special stationary state (e.g., the indicating information "red 7", "red 7", and "red 7" are rearranged in the stationary state). Upon completion of this processing, the CPU 106 switches the processing to step S10.

In step S10, the CPU 106 performs gaming medium payout amount storage processing. In this processing, the CPU 106 stores the gaming medium payout amount, which is used in the processing in which a predetermined amount of the gaming medium is paid out, in a predetermined memory region of the RAM 110, according to the determination made in step S4 that the game state is to be switched to a special game state advantageous to the player. Upon completion of this processing, the CPU 106 ends one game.

In step S11, the CPU 106 performs a control operation so as to display the indicating information in a stationary state other than the aforementioned predetermined special stationary state. In this processing, the CPU 106 transmits a command which is an instruction to the motor driving circuit 120 to display the indicating information depicted on the mechanical reels 30A through 30C on the display screen 10 in a stationary state other than the aforementioned predetermined special stationary state (e.g., other than the state in which the indicating information "red 7", "red 7", and "red 7" are rearranged in the stationary state). Upon reception of this command, the motor driving circuit 120 performs a control operation so as to display the indicating information depicted on the mechanical reels 30A through 30C on the display screen 10 in a stationary state other than the aforementioned predetermined special stationary state. Upon completion of this processing, the CPU 106 ends one game.

In other words, the CPU 106 serves as an example of a game control means for controlling the execution of a game.

Next, a description is provided regarding the light-emission/illumination intensity table used as a reference by the CPU 106 in the processing denoted by step S7 and step S8 described above.

FIG. 5 shows the light-emission/illumination intensity table.

The light-emission/illumination intensity table, which is stored in the ROM 108, specifies the correspondence between the probability that the game state will transit to an advantageous game state, the kind of living thing, and the illumination intensity of the lamp. Specifically, if the probability that the game state will transit to the advantageous game state is 100%, the lamp illumination intensity is 100; if the probability is 80%, the lamp illumination intensity is 80; if the probability is 60%, the lamp illumination intensity is 60; if the probability is 40%, the lamp illumination intensity is 40; and if the probability is 20%, the lamp illumination intensity is 20. In addition, if the probability that the game state will transit to the advantageous game state is 100%, the living thing associated with this probability is the living thing 600*e*; if the probability is 80%, the associated living thing is the living thing 600*d*; if the probability is 60%, the associated living thing is the living thing 600*c*; if the probability is 40%, the associated living thing is the living thing 600*b*; and if the probability is 20%, the associated living thing is the living thing 600*a*.

In other words, the ROM 108 that stores the light-emission/illumination intensity table serves as an example of a storage means for storing a light emission table that specifies the correspondence between the kind of living thing and the light-emission data, which is to be used for instructing the light-emitting means to emit multiple kinds of lights for each of the multiple kinds of living things.

Figure 6:
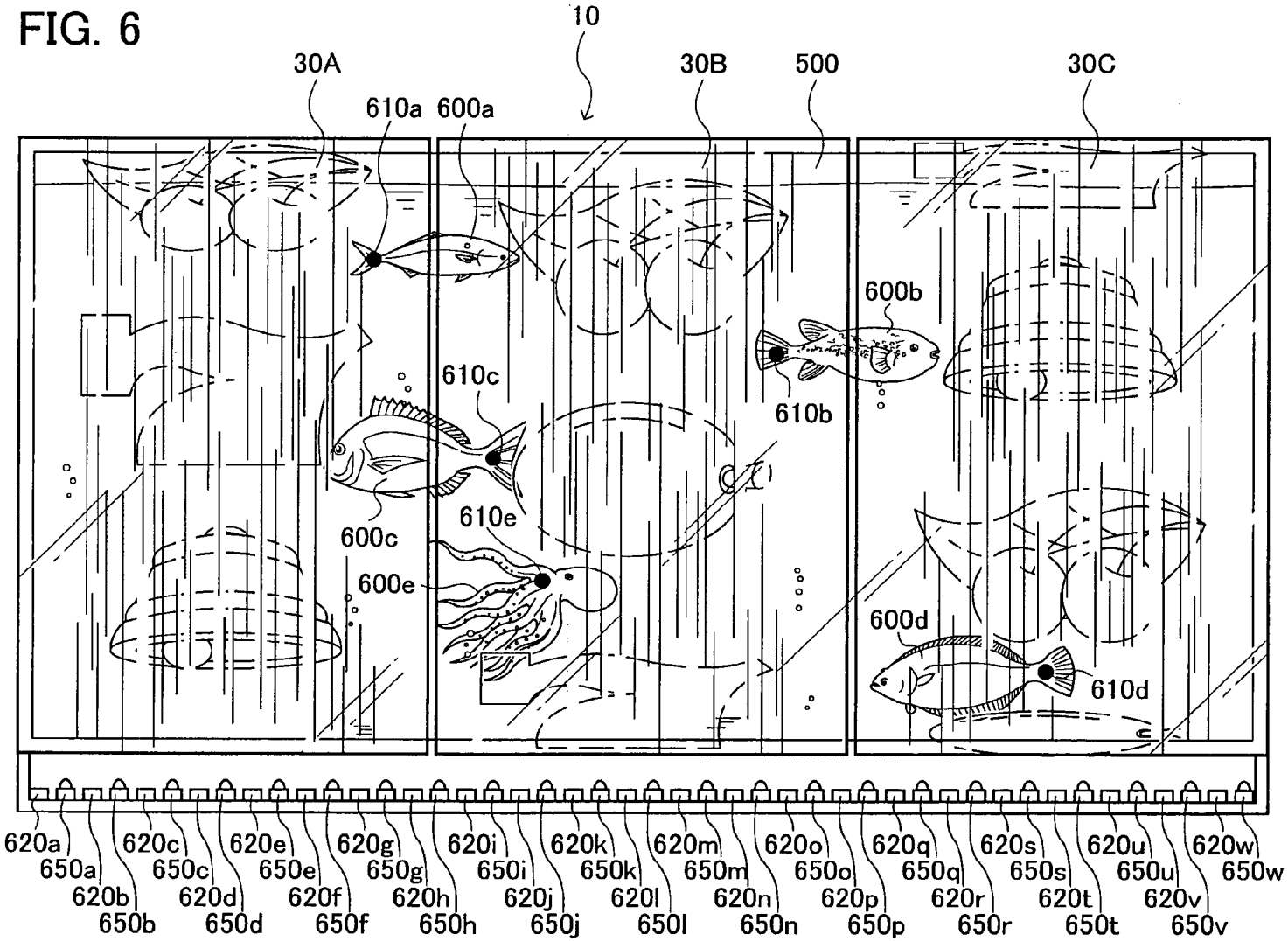
FIG. 6 is a front view showing a display screen for displaying mechanical reels, a water tank, lamps, and sensors, according to the embodiment of the present invention.
Figure 7:
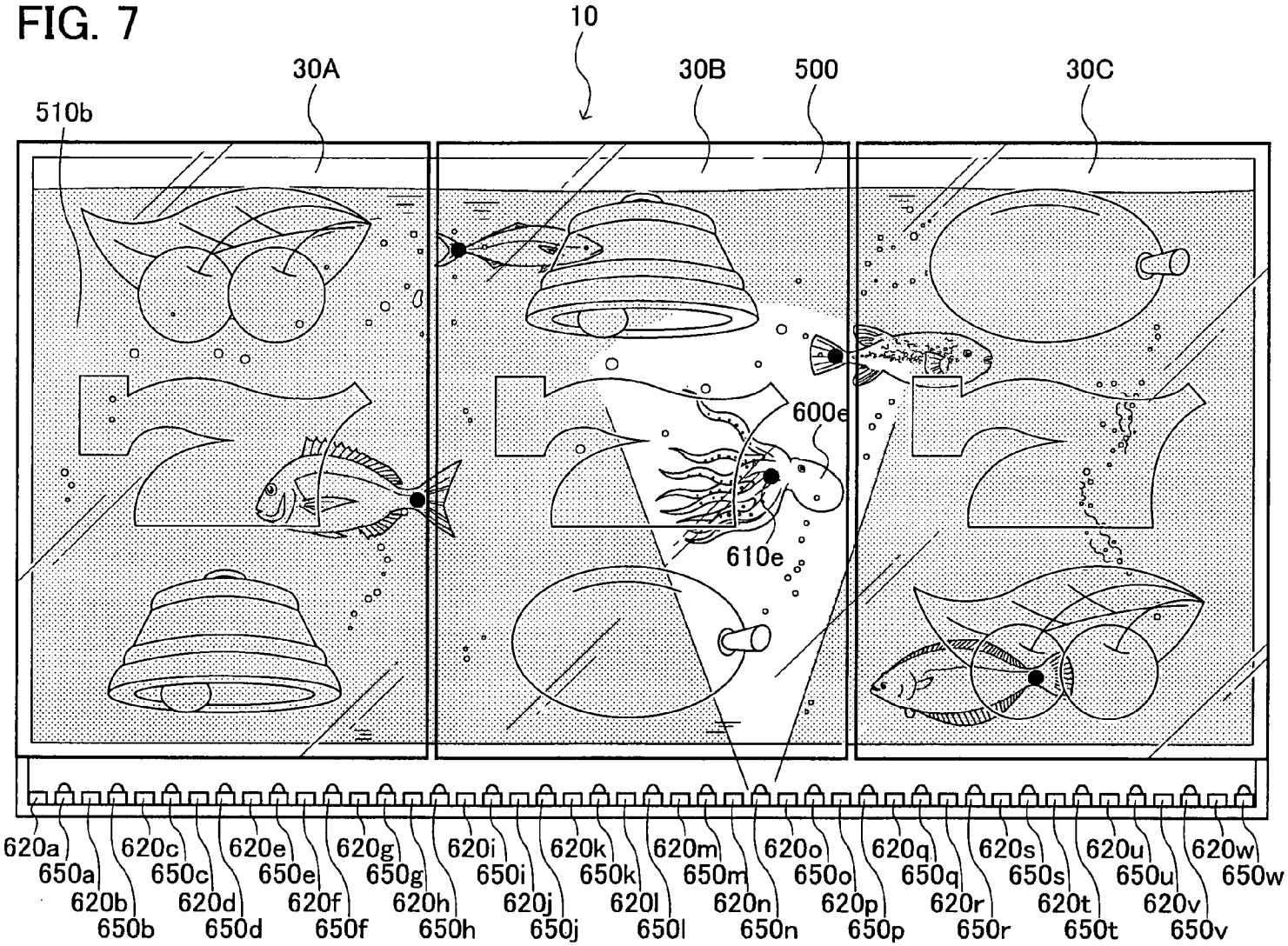
FIG. 7 is a front view showing the display screen for displaying the mechanical reels, the water tank, the lamps, and the sensors, according to the embodiment of the present invention.

Next, a description is provided regarding the light emission visual effect processing provided by the slot machine 1 according to the first embodiment of the present invention. FIG. 6 and FIG. 7 are front views showing the display screen 10 for displaying the mechanical reels 30A through 30C, the water tank 500, the lamps 650*a* through 650*w*, and the sensors 620*a* through 620*w*, according to the first embodiment.

As shown in FIG. 6, multiple kinds of indicating information are displayed variably on the display screen 10 that displays the mechanical reels 30A through 30C. In this stage, all the lamps 650*a* through 650*w* emit light with a predetermined illumination intensity. Furthermore, the sensors 620*a* through 620*w* are arranged at predetermined intervals, and emit electromagnetic waves at multiple different frequencies, respectively. Each of the resonant tags 610*a* through 610*e* emits a corresponding echo wave when it receives one of the multiple electromagnetic waves thus emitted at different frequencies. The sensors 620*a* through 620*w* receive these echo waves thus emitted. The CPU 106 (see FIG. 3) analyzes the echo waves received by the sensors 620*a* through 620*w*, thereby detecting the positions and kinds of the living things 600*a* through 600*e*.

In the next stage, as shown in FIG. 7, the indicating information provided by the mechanical reels 30A through 30C are displayed on the display screen 10 in a predetermined special stationary state (e.g., the indicating information "red 7", "red 7", and "red 7" are rearranged in the stationary state). If the indicating information are displayed in such a predetermined special stationary state, a lamp (e.g., the lamp 650*n*) is selected from among the lamps 650*a* through 650*w* based upon the information with respect to the positions and kinds of the living things 600*a* through 600*e* detected by the CPU 106 (see FIG. 3). Then, the lamp thus selected emits light toward a predetermined kind of living thing (e.g., the living thing 600*e*).

The first embodiment provides the following advantages.

(1) When the player performs an operation on either the spin repeat BET switch 11C or the start switch 11D, the CPU 106 determines whether or not the game state is to be switched to a special game state advantageous to the player. The mechanical reels 30A through 30C formed of a translucent material provide a function of displaying multiple kinds of indicating information variably and statically. The motor driving circuit 120 controls the display operation of the mechanical reels 30A through 30C for displaying the indicating information variably and statically according to the result of the determination made by the CPU 106. Furthermore, the water tank 500, which is capable of retaining liquid and is formed of a translucent material, is provided behind the display screen 10 that displays the indicating information provided by the mechanical reels 30A through 30C.

With such an arrangement, the drive control circuit 300 performs a control operation which instructs the lamps 650*a* through 650*w*, which provide a function of emitting multiple kinds of lights, to emit a light selected from among the multiple kinds of lights to the liquid stored in the water tank 500.

With such an arrangement, the water tank 500, which retains liquid, is provided behind the mechanical reels 30A through 30C, which provide a function of displaying multiple kinds of indicating information variably and statically. Such an arrangement allows the player to recognize both the multiple kinds of indicating information provided by the mechanical reels 30A through 30C, displayed via the display screen 10, and the water tank 500, provided behind the display screen 10. Furthermore, with such an arrangement, the water tank 500 can be designed without having to take into account whether or not the water tank 500 interrupts the player's view of the display screen 10 that displays the indicating information depicted on the mechanical reels 30A through 30C. Thus, with such an arrangement, the water tank 500 can be formed with an increased depth as compared with an arrangement in which the water tank 500 is provided forward of the mechanical reels 30A through 30C. Various kinds of items which provide visual effects (e.g., simulated pirate ships, simulated tropical fish, and simulated aquatic plants, all of which can be moved by magnetic force) can be arranged in such a water tank 500 thus designed.

Furthermore, the CPU 106 instructs the mechanical reels 30A through 30C to display the indicating information variably and statically according to the result of the determination of whether or not the game state is to be switched to a special game state advantageous to the player. In addition, the CPU 106 instructs the lamps 650*a* through 650*w* to emit a light selected from among the multiple kinds of lights toward the liquid stored in the water tank 500. Thus, with such an arrangement, visual effects, including the display of indicating information variably and statically and the emission of light toward the liquid stored in the water tank 500, are displayed in a superimposed manner. The player is thus notified that the game state will transit to a special game state advantageous to the player, which is of great interest to the player. This provides improved visual effects using the water tank 500.

Thus, such an arrangement provides improved visual effects by using the water tank 500, while facilitating the player's ability to visually recognize the information displayed on the mechanical reels 30A through 30C.

(2) The drive control circuit 300 performs a control operation which instructs the lamps 650*a* through 650*w* to emit light toward the living things 600*a* through 600*e* based upon the position information detected by the CPU 106 with respect to the living things 600*a* through 600*e* contained in the water tank 500.

Such an arrangement provides a function of emitting a light selected from among the multiple kinds of lights toward the living things 600*a* through 600*e*.

With such an arrangement, the CPU 106 determines by random number lottery whether or not the game state is to be switched to a special game state advantageous to the player, upon which the drive control circuit 300 performs a control operation which instructs the lamps 650*a* through 650*w* to emit a light selected from among the multiple kinds of lights with reference to the illumination intensity table according to the result of the determination of whether or not the game state is to be switched to the special game state advantageous to the player. Here, the ROM 108 is provided, and the ROM 108 stores the illumination intensity table, which specifies the relation between the probability that the game state will transit to the advantageous game state and is used in the random number lottery processing, and the illumination intensity of the light to be emitted by the lamps 650*a* through 650*w*. In the illumination intensity table, the illumination intensity of the light is proportional to the probability that the game state will transit to the advantageous game state. With such an arrangement, the illumination intensity of the light to be emitted becomes higher as the probability that the game state will transit to the advantageous game state becomes greater. With such an arrangement, the emission of light at a high illumination intensity further enhances the player's sense of expectation with respect to the game state transition to the special game state advantageous to the player.

Thus, such an arrangement provides improved visual effects by using the water tank 500, while facilitating the player's ability to visually recognize the information displayed on the mechanical reels 30A through 30C.

(3) The CPU 106 identifies the kind of each of the multiple kinds of the living things 600*a* through 600*e*. The ROM 108 stores the light-emission/illumination intensity table that specifies the association between each of the multiple kinds of living things 600*a* through 600*e* and the corresponding light emission data from among the multiple kinds of light emission data, which is used in the light-emission operation of the lamps 650*a* through 650*w*, each of which has a function of emitting multiple kinds of lights.

With such an arrangement, the drive control circuit 300 performs a control operation which instructs the lamps 650*a* through 650*w* to emit a light selected from among the multiple kinds of lights corresponding to the kind of living thing thus identified by the CPU 106 with reference to the light-emission/illumination intensity table stored in the ROM 108.

Thus, such an arrangement provides a function whereby, when a particular living thing is selected from among the multiple kinds of living things 600*a* through 600*e*, a light is selected from among the multiple kinds of lights corresponding to the particular living thing thus selected, and the light thus selected is emitted toward the particular living thing thus selected.

With such an arrangement, the CPU 106 determines by random number lottery whether or not the game state is to be switched to a special game state advantageous to the player, upon which the drive control circuit 300 performs a control operation which instructs the lamps 650*a* through 650*w* to emit a light selected from among multiple kinds of lights with reference to the light-emission/illumination intensity table according to the result of the determination of whether or not the game state is to be switched to the special game state advantageous to the player. The ROM 108 stores a light-emission/illumination intensity table, which specifies the relation between the probability that the game state will transit to the advantageous game state and is used in the random number lottery processing, and the multiple kinds of living things 600*a* through 600*e*. With such an arrangement, a particular living thing is illuminated as the probability that the game state will transit to the advantageous game state becomes higher. With such an arrangement, illumination of a particular living thing further enhances the player's sense of expectation with respect to the game state transition to the special game state advantageous to the player.

Thus, such an arrangement provides improved visual effects by using the water tank 500, while facilitating the player's ability to visually recognize the information displayed on the mechanical reels 30A through 30C.

The first embodiment can be said to provide a gaming machine, as described in the first aspect of the present invention, including: a water tank (e.g., the water tank 500 according to the first embodiment) including visible living things (e.g., the living things 600*a* through 600*e* according to the first embodiment); an emitting means (e.g., the resonant tags 610*a* through 610*e* according to the first embodiment) each of which is provided to a corresponding living thing, and each of which has a function of emitting an echo wave; a detecting means (e.g., the sensors 620*a* through 620*w* according to the first embodiment) which emits an electromagnetic wave toward the interior of the water tank and has a function of detecting the echo wave emitted from the emitting means; and a position identifying means (e.g., the CPU 106 according to the first embodiment) for identifying the position of each of the living things based upon the echo waves detected by the detecting means. With such an arrangement, the aforementioned light emission control means (e.g., the drive control circuit 300 according to the first embodiment) performs a control operation which instructs the light emitting means to emit a light selected from among multiple kinds of lights based upon the position of the living thing identified by the position identifying means.

With such an arrangement, the emitting means, which has a function of emitting an echo wave, is provided to each living thing contained in the water tank. The detecting means emits an electromagnetic wave toward the interior of the water tank, which causes the emitting means to emit an echo wave. Furthermore, the detecting means has a function of detecting the echo wave thus emitted by the emitting means. The position identifying means identifies the position of the living thing based upon the echo wave detected by the detecting means.

Subsequently, the light emission control means performs a control operation which instructs the light emitting means to emit a light selected from among multiple kinds of lights based upon the position of the living thing identified by the position identifying means.

Thus, such an arrangement allows a light selected from among multiple kinds of lights to be emitted toward the position of the living thing, or toward a position a predetermined distance apart from the position of the living thing.

With such an arrangement, a game control means determines by random number lottery whether or not the game state is to be switched to a special game state advantageous to the player, upon which the light emission control means performs a control operation which instructs the light emitting means to emit a light selected from among the multiple kinds of lights with reference to an illumination target position table according to the result of the determination of whether or not the game state is to be switched to the special game state advantageous to the player. A storage means is provided for storing an illumination target position table that specifies the association between the probability that the game state will transit to the advantageous game state, which is used in the random number lottery processing, and the distance between the living thing and the targeted position toward which the light is to be emitted. In the illumination target position table, the distance between the living thing and the targeted position toward which the light is to be emitted is inversely proportional to the probability that the game state will transit to the advantageous game state. With such an arrangement, the position toward which the light is to be emitted becomes closer to the living thing as the probability that the game state will transit to the advantageous game state becomes higher. With such an arrangement, the emission of light toward a position close to the living thing further enhances the player's sense of expectation with respect to the game state transition to the special game state advantageous to the player.

Thus, such an arrangement provides improved visual effects by using the water tank, while facilitating the player's ability to visually recognize the information displayed by the display means.

In addition, the first embodiment can be said to provide a gaming machine, as described in the first aspect of the present invention, including: a water tank which is stocked with multiple kinds of visible living things; an emitting means, each of which is provided to a corresponding living thing from among the aforementioned multiple kinds of living things, and has a function of emitting echo waves at respective different frequencies according to the aforementioned multiple kinds of living things; a detecting means which emits an electromagnetic wave toward the interior of the water tank, causes the aforementioned emitting means to emit echo waves, and has a function of detecting the echo waves thus emitted from the emitting means at the respective different frequencies; a position identifying means which identifies the position of each of the multiple kinds of living things based upon the echo waves detected by the detecting means; and a storage means (e.g., the ROM 108 according to the first embodiment) which stores a light emission table (e.g., the light-emission/illumination intensity table according to the first embodiment) that specifies the association between each of the frequencies of the echo waves emitted from the emitting means and the corresponding light from among the multiple kinds of lights, which are used in the light emission operation of the light emitting means for emitting the light selected from among the multiple kinds of lights. With such an arrangement, the aforementioned light emission control means performs a control operation which instructs the light emitting means to emit a light selected from among multiple kinds of lights based upon the positions of the multiple kinds of living things identified by the position identifying means with reference to the light emission table stored in the storage means.

With such an arrangement, an emitting means, which has a function of emitting an echo wave at a corresponding frequency, is provided to each of the multiple kinds of living things stored in the water tank. The detecting means emits electromagnetic waves toward the interior of the water tank, which causes the emitting means to emit echo waves. Furthermore, the detecting means has a function of detecting the echo wave thus emitted at respectively different frequencies by the emitting means. The position identifying means identifies the position of each of the multiple kinds of living things based upon the echo waves detected by the detecting means. The storage means stores the light emission table that specifies the association between each of the frequencies of the echo waves emitted from the emitting means and the corresponding light from among the multiple kinds of lights, which are used in the light emission operation of the light emitting means for emitting the light selected from among the multiple kinds of lights.

Subsequently, the light emission control means performs a control operation which instructs the light emitting means to emit a light selected from among the multiple kinds of lights, based upon the position of each of the multiple kinds of living things identified by the position identifying means, with reference to the light emission table stored in the storage means.

Thus, such an arrangement allows a light selected from among multiple kinds of lights to be emitted toward the position of any particular one of the living things.

With such an arrangement, the game control means determines by random number lottery whether or not the game state is to be switched to a special game state advantageous to the player, upon which the light emission control means performs a control operation which instructs the light emitting means to emit a light selected from among the multiple kinds of lights with reference to an illumination target position table and a light emission table according to the result of the determination of whether or not the game state is to be switched to the special game state advantageous to the player. A storage means is provided for storing an illumination target position table that specifies the association between the probability that the game state will transit to the advantageous game state, which is used in the random number lottery processing, and the distance between the targeted position toward which the light is to be emitted and the position of the targeted living thing, which is provided with the emitting means that has a function of emitting an echo wave at a specific frequency. In the illumination target position table, the distance between the living thing and the targeted position toward which the light is to be emitted is inversely proportional to the probability that the game state will transit to the advantageous game state. With such an arrangement, the position toward which the light is to be emitted becomes closer to the living thing as the probability that the game state will transit to the advantageous game state becomes higher. With such an arrangement, the emission of light toward a position close to a particular living thing further enhances the player's sense of expectation with respect to the game state transition to the special game state advantageous to the player.

Thus, such an arrangement provides improved visual effects by using the water tank, while facilitating the player's ability to visually recognize the information displayed by the display means.

Second Embodiment

In the following description of a second embodiment, the same components as those in the first embodiment are denoted by the same reference numerals, and descriptions thereof are omitted or simplified.

Figure 8:
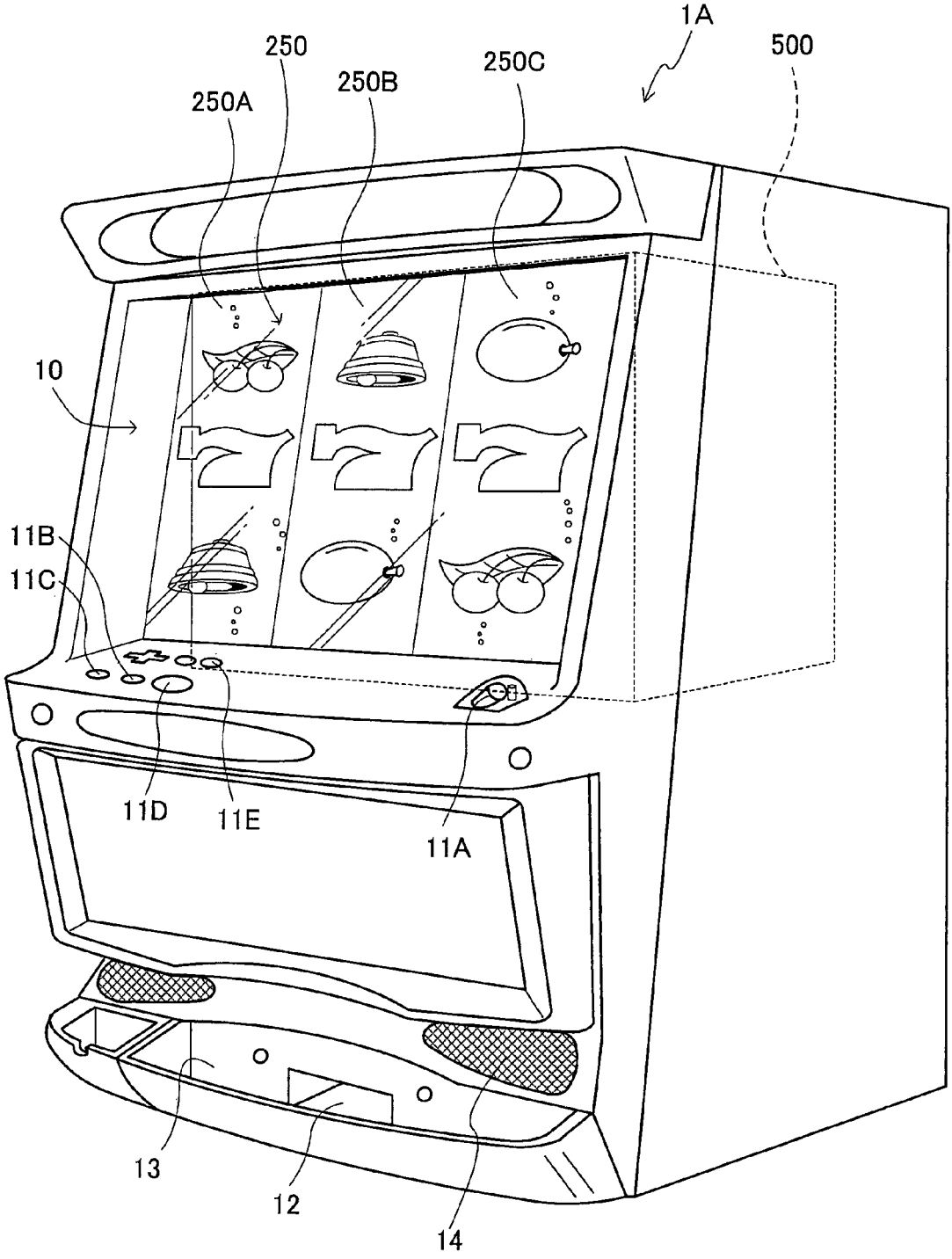
FIG. 8 is a perspective view showing the exterior of a slot machine according to a second embodiment of the present invention.

FIG. 8 is a perspective view showing the exterior of a slot machine 1A according to a second embodiment of the present invention.

Figure 9:
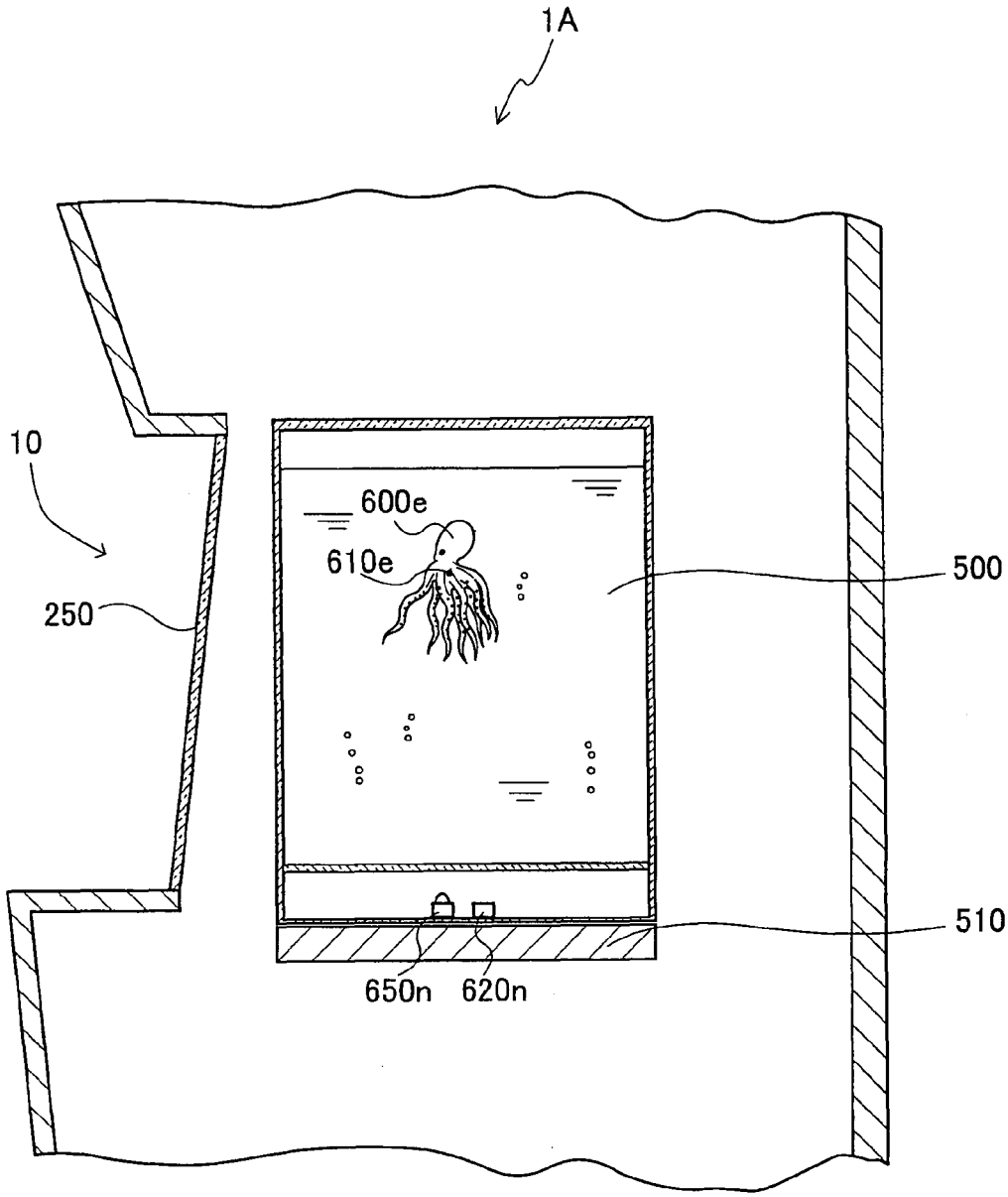
FIG. 9 is a cross-sectional view showing a liquid crystal display device and a water tank included in the slot machine according to the second embodiment of the present invention.

FIG. 9 is a cross-sectional view of a liquid crystal display device 250 and the water tank 500 included in the slot machine 1A according to the second embodiment of the present invention.

The slot machine 1A according to the second embodiment differs from the first embodiment in that it includes the liquid crystal display device 250 instead of the mechanical reels 30A through 30C included in the first embodiment.

Furthermore, the slot machine 1A according to the second embodiment differs from the first embodiment in that it also includes a display control device 200 instead of the motor driving circuit 120 included in the first embodiment.

The liquid crystal display device 250 is provided forward of the water tank 500, and has a function of displaying multiple kinds of indicating information on three indicating information display regions 250A through 250C variably and statically. Here, each of the three indicating information display regions 250A through 250C has a configuration in which a transparent substrate such as a glass substrate, upon which a thin film transistor layer has been formed, and another transparent substrate are mounted so as to face each other with a certain gap between them, and the gap between the substrates is filled with a liquid crystal.

In other words, the liquid crystal display device 250 is provided forward of the water tank, and serves as an example of a liquid crystal display device which provides a function of displaying the indicating information variably and statically.

Figure 10:
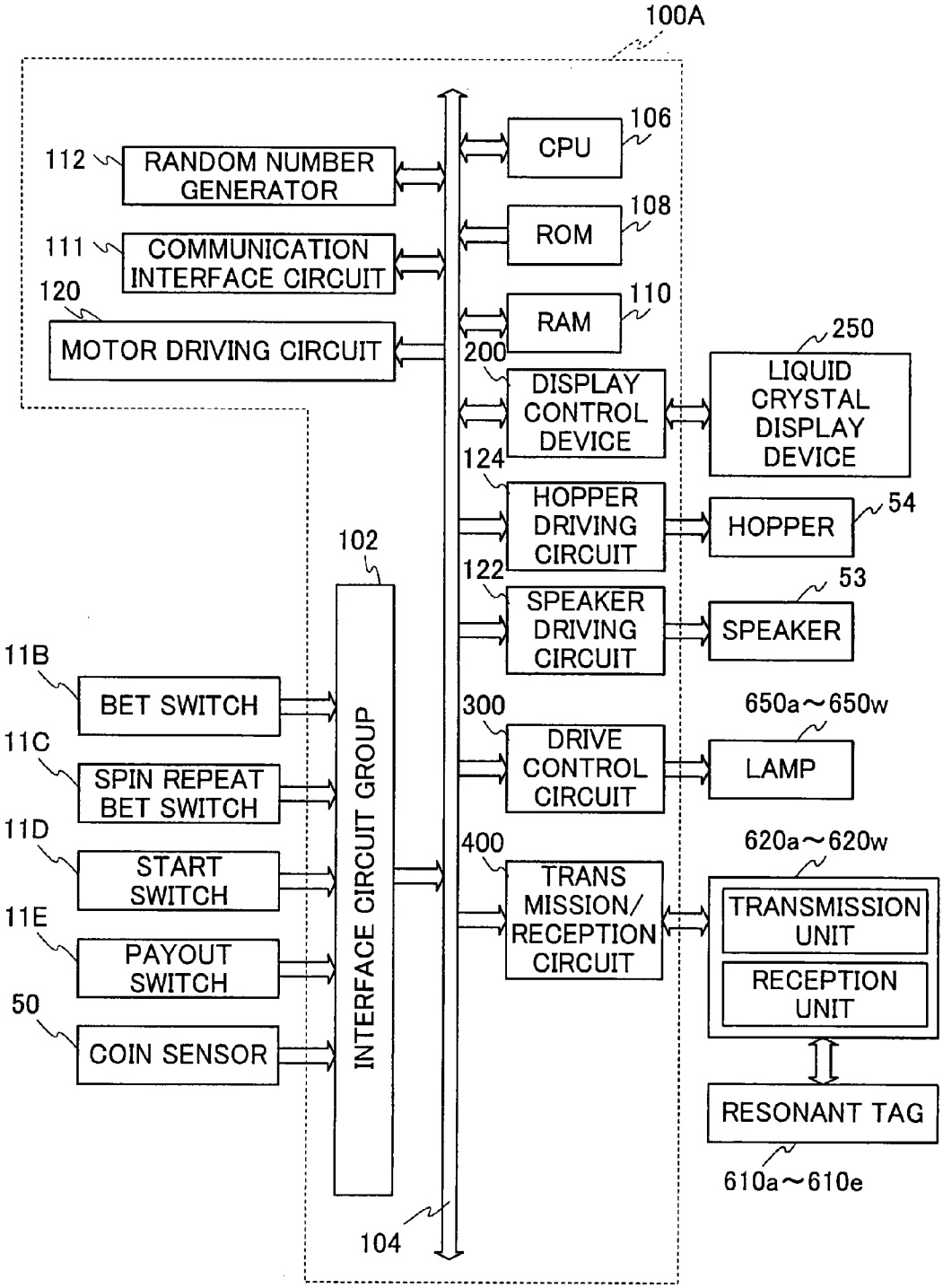
FIG. 10 is a block diagram showing an electrical configuration of a control device according to the second embodiment of the present invention.

FIG. 10 is a block diagram showing an electrical configuration of a control device 100A according to the present embodiment of the invention.

The display control device 200 is connected to the input/output bus 104. The CPU 106 generates an image display command corresponding to the state and results of the game, and outputs the image display command thus generated to the display control device 200 via the input/output bus 104. Upon reception of the image display command as an input signal from the CPU 106, the display control device 200 generates a driving signal for driving the liquid crystal display device 250 according to the image display command thus received. Then, the display control device 200 outputs the driving signal thus generated to the liquid crystal display device 250. With such an arrangement, the liquid crystal display device 250 provides a function of displaying multiple kinds of indicating information on the indicating information display regions 250A through 250C variably and statically.

In other words, the display control device 200 serves as an example of a display control means which is a display control circuit that controls the liquid crystal display device.

Next, a description is provided regarding the processing performed by the CPU 106, which executes a game provided by the slot machine 1 according to the second embodiment, with reference to the flowchart shown in FIG. 4.

The processing denoted by step S1 and the processing denoted by step S2 are the same as in the first embodiment.

In step S3, the CPU 106 performs indicating information variable display control processing. In this processing, the CPU 106 transmits a command to the display control device 200, which instructs the liquid crystal display device 250 to display multiple kinds of indicating information variably. Upon reception of this command, the display control device 200 performs a control operation so as to display multiple kinds of indicating information on the indicating information display regions 250A through 250C of the liquid crystal display device 250 variably. Upon completion of this processing, the CPU 106 switches the processing to step S4.

The processing denoted by step S4 through step S8 is the same as in the first embodiment.

In step S9, the CPU 106 performs a control operation so as to display the indicating information in a predetermined special stationary state. In this processing, the CPU 106 transmits a command to the display control device 200, which instructs the liquid crystal display device 250 to display the multiple kinds of indicating information in a predetermined special stationary state (e.g., the indicating information "red 7", "red 7", and "red 7" are rearranged in the stationary state). Upon reception of this command, after the multiple kinds of indicating information have been displayed on the indicating information display regions 250A through 250C of the liquid crystal display device 250 variably, the display control device 200 performs a control operation so as to display the indicating information in the predetermined special stationary state (e.g., the indicating information "red 7", "red 7", and "red 7" are rearranged in the stationary state). Upon completion of this processing, the CPU 106 switches the processing to step S10.

The processing denoted by step S10 is the same as in the first embodiment.

In step S11, the CPU 106 performs a control operation so as to display the indicating information in a stationary state other than the aforementioned predetermined special state. In this processing, the CPU 106 transmits a command to the display control device 200, which instructs the liquid crystal display device 250 to display the indicating information in a stationary state other than the a special stationary state (e.g., the indicating information "red 7", "red 7", and "red 7" are rearranged in the stationary state) after the multiple kinds of indicating information have been displayed variably. Upon reception of this command, after the multiple kinds of indicating information have been displayed variably, the display control device 200 performs a control operation so as to display the indicating information on the indicating information display regions 250A through 250C of the liquid crystal display device 250 in a stationary state other than the special stationary state. Upon completion of this processing, the CPU 106 ends one game.

The second embodiment provides the following advantages. The liquid crystal display device 250, which is provided forward of the water tank 500, is employed as a display means. Furthermore, the display control device 200, which controls the liquid crystal display device 250, is employed as a display control means.

Such an arrangement allows the indicating information to be displayed variably and statically using various images. Furthermore, with such an arrangement, the liquid crystal display device 250 is formed of a translucent material, and is provided forward of the water tank 500. Such an arrangement allows the indicating information and the water tank to be displayed in a superimposed manner.

Thus, such an arrangement provides improved visual effects by using the water tank, while facilitating the player's ability to visually recognize the information displayed by the display means.

The embodiments according to the present invention have been described above with reference to specific examples for exemplary purpose only, and it should be clearly understood that the embodiments in no way restrict the present invention. That is to say, the gaming machine according to the present invention principally includes: an operating means for allowing the player to operate the gaming machine; a game control means for providing a function whereby, upon the player performing an operation on the aforementioned operating means, determination is made whether or not the game state is to be switched to a special game state advantageous to the player; a display means, which is formed of a translucent material, for providing a function of displaying multiple kinds of indicating information variably and statically; a display control means for controlling the display operation of the aforementioned display means, which has a function of displaying the indicating information variably and statically, according to the result of the determination made by the aforementioned game control means; a water tank which is formed of a translucent material, retains liquid, and is provided behind the display screen of the aforementioned display means for displaying the indicating information; a light emitting means for emitting multiple kinds of lights toward the liquid stored in the water tank; and a light emission control means for performing a control operation which instructs the light emitting means to emit a light selected from among the multiple kinds of lights according to the result of the determination made by the game control means. With such an arrangement, the components such as the operating means, the game control means, the display means, the display control means, the water tank, the light emitting means, the light emission control means, etc., may be modified and altered as necessary.

Moreover, it should be noted that the advantages described in association with the embodiments of the present invention are merely a listing of most preferred advantages of the present invention, and that the advantages of the present invention are by no means restricted to those described in connection with the embodiments of the present invention.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention.

Accordingly, the invention is not to be considered to be limited by the foregoing description and is only limited by the scope of the appended claims.

EXPLANATION OF THE REFERENCE SYMBOLS

1, 1A: slot machine
10: display screen
11: operation panel
12: coin payout opening
13: coin tray
14: sound output unit
30: reel group
30A to 30E: mechanical reel
100, 100A: control device
102: interface circuit group
104: input/output bus
106: CPU
108: ROM
110: RAM
111: communication interface circuit
112: random number generator
120: motor driving circuit
122: speaker driving circuit
124: hopper driving circuit
128: display unit driving circuit
200: display control device
250: liquid crystal display device
300: drive control circuit
400: transmission/reception circuit
500: water tank
600*a* to 600*e*: living thing
610*a* to 610*e*: resonant tag
620*a* to 620*w*: sensor
650*a* to 650*w*: lamp

What is claimed is:

1. A gaming machine comprising:

an operating device for allowing a player to operate the gaming machine;

a game control device for providing a function whereby, upon the player performing an operation on the operating device, determination is made whether or not a game state is to be switched to a special game state advantageous to the player;

a display device, which is formed of a translucent material, for displaying a plurality of kinds of indicating information variably and statically;

a display control device for controlling a display operation of the display device, which provides a function of displaying the indicating information variably and statically, according to a result of a determination made by the game control device;

a water tank, which is formed of a translucent material, retains liquid, and is provided behind a display screen of the display device for displaying the indicating information;

a light emitting device for emitting a plurality of kinds of light toward the liquid stored in the water tank;

a light emission control device for performing a control operation which instructs the light emitting device to emit a kind of light selected from among the plurality of kinds of light according to the result of the determination made by the game control device; and a position identifying device for identifying a position of a visible living thing; wherein the water tank is stocked with the visible living thing, and the light emission control device performs a control operation which instructs the light emitting device to emit light toward the visible living thing based upon the position of the visible living thing identified by the position identifying device.

2. A gaming machine comprising:

an operating device for allowing a player to operate the gaming machine;

a game control device for providing a function whereby, upon the player performing an operation on the operating device, determination is made whether or not a game state is to be switched to a special game state advantageous to the player;

a display device, which is formed of a translucent material, for displaying a plurality of kinds of indicating information variably and statically;

a display control device for controlling a display operation of the display device, which provides a function of displaying the indicating information variably and statically, according to a result of a determination made by the game control device;

a water tank which is formed of a translucent material, retains liquid, and is provided behind a display screen of the display device for displaying the indicating information;

a light emitting device for emitting a plurality of kinds of light toward the liquid stored in the water tank;

a light emission control device for performing a control operation which instructs the light emitting device to emit a kind of light selected from among the plurality of kinds of light according to the result of the determination made by the game control device, wherein the water tank is stocked with a plurality of kinds of visible living things, the gaming machine further comprising:

a kind identifying device for identifying each of the plurality of kinds of living things; and a storage device for storing a light emission table that specifies an association between each of the plurality of kinds of living things and a corresponding kind of light from among a plurality of kinds of light, which is used in a light emission operation of the light emitting device which has a function of emitting the plurality of kinds of light, and wherein the light emission control device performs a control operation which instructs the light emitting device to emit a kind of light selected from among the plurality of kinds of light according to each of the plurality of kinds of living things identified by the kind identifying device with reference to the light emission table stored in the storage device.

* * * * *